US010798983B2

(12) United States Patent
Sharrad

(10) Patent No.: US 10,798,983 B2
(45) Date of Patent: Oct. 13, 2020

(54) HOODED CLOTHING ARRANGEMENT AND CAP

(71) Applicant: CAPHAT HOLDINGS PTY LTD, Ironbank (AU)

(72) Inventor: Bernard John Sharrad, Ironbank (AU)

( * ) Notice: Subject to any disclaimer, the term of this patent is extended or adjusted under 35 U.S.C. 154(b) by 468 days.

(21) Appl. No.: 14/857,686

(22) Filed: Sep. 17, 2015

(65) Prior Publication Data

US 2017/0079360 A1 Mar. 23, 2017

(51) Int. Cl.
*A42B 1/04* (2006.01)
*A42B 1/06* (2006.01)
*A42B 5/00* (2006.01)

(52) U.S. Cl.
CPC ..... *A42B 1/067* (2013.01); *A42B 1/048* (2013.01); *A42B 5/00* (2013.01)

(58) Field of Classification Search
CPC ..... A42B 1/067; A42B 1/048; A42B 5/00
See application file for complete search history.

(56) References Cited

U.S. PATENT DOCUMENTS 2,230,805 A * 2/1941 Levy ..... A42B 1/067 2/172
2,897,510 A * 8/1959 Forbes-Robinson ..... A42B 1/066 2/172
3,100,896 A * 8/1963 Khanbegian ..... A42B 3/105 2/205
4,272,853 A * 6/1981 Schuessler ..... A42B 3/105 2/205
5,062,163 A * 11/1991 Avey ..... A42B 1/067 2/410
5,153,943 A * 10/1992 Clement ..... A42B 1/067 2/172
5,448,778 A * 9/1995 Phillips ..... A42B 1/067 2/172
5,694,647 A * 12/1997 Crickmore ..... A42B 1/067 2/10
D674,994 S 1/2013 Danner
D710,433 S 8/2014 Danner
8,806,664 B1 * 8/2014 Judge ..... A42B 3/105 2/84
8,914,914 B1 * 12/2014 Blake ..... A42B 1/069 2/175.1
9,057,888 B2 6/2015 Danner
9,320,310 B1 * 4/2016 Judge ..... A42B 3/105
2009/0151049 A1 * 6/2009 Conrardy ..... A42B 1/067 2/206

(Continued)

*Primary Examiner* — Katharine Gracz
(74) *Attorney, Agent, or Firm* — Martin IP Pty Ltd

(57) ABSTRACT

Headwear for partially covering a hat is described wherein the hat has a crown and a headband region. The headwear comprises a piece of material of an irregular shape which has an aperture located closer to a side portion of the headwear material than other sides of the material. The aperture size is adjustable so as to permit the headwear material to be fixable to the hat about the headband region of the hat and to leave the crown of the hat uncovered by the material. The specification also discloses a hood for clothing having an adjustable sized aperture so as to permit the hood material to be fixable to the hat about the headband region of the hat and to leave the crown of the hat uncovered by the material while the hood is still part of the clothing such as a sweat shirt.

8 Claims, 12 Drawing Sheets

(56) References Cited

U.S. PATENT DOCUMENTS

| | | | | |
|---|---|---|---|---|
| 2009/0151055 | A1* | 6/2009 | Duncan | A42B 1/048 2/410 |
| 2011/0145977 | A1* | 6/2011 | Oates | A42B 1/067 2/182.8 |
| 2012/0030858 | A1* | 2/2012 | Duffin | A42B 3/0406 2/183 |
| 2014/0143942 | A1* | 5/2014 | Ocando | A42B 1/048 2/455 |
| 2014/0165259 | A1* | 6/2014 | Beverage | A42B 1/048 2/84 |
| 2015/0057621 | A1* | 2/2015 | Coombs | A42B 1/18 604/289 |
| 2015/0096102 | A1* | 4/2015 | Dick | A42B 1/008 2/171.3 |

* cited by examiner

HOODED CLOTHING ARRANGEMENT AND CAP

FIELD OF THE INVENTION

The field of the disclosure is clothing and in particular headwear.

BACKGROUND OF THE INVENTION

Headwear has uses including the protection and decoration of the head of the wearer.

Protective headwear is typically made of durable and strong material and is typically shaped to cover the crown of the head of the wearer's skull leaving the ear's, neck and face exposed since the protective effect of the headwear is intended to cushion impacts to the crown of the wearer, although there are sporting and specialist tasks for which alternative protective headwear is used.

Decorative headwear is specifically designed to appeal to the aesthetics of the wearer. In some instances the allegiances or business of the wearer are displayed, by colour and other means as part of or on the headwear, since decorative headwear may include words and symbols on the front, side or rear of the crown portion of the headwear, illustrating those allegiances or business connection.

It is thus possible that the adverse effects of sun and wind can affect the wearer, despite the use of the protective or decorative headwear, since most headwear does not provide protection for all eventualities. In some arrangements, the head wear includes a visor/peak, or in some cases a circumferential brim to lessen the effects of in particular the sun.

Sometimes the wearer of the headwear will wear an article of clothing that incorporates a hood (or hoddie in the current vernacular). The hood is comprised of material (typically the same material as the article of clothing, typically a sweatshirt or jacket) which extends the collar portion of the clothing, or is an optional part of the clothing, releasably attachable to the collar portion of the article of clothing. The hood is thus able to be pulled over the head of the wearer while attached to the clothing to cover the head of the wearer. If the hood is large enough, it can also be pulled over headwear being worn by the user, which then becomes the outer layer of the protective headwear or covers the decorative headwear.

BRIEF SUMMARY OF THE INVENTION

Headwear for partially covering a hat is described wherein the hat has a crown and a headband region. The headwear comprises preferably a single piece of material of an irregular shape and has an aperture located closer to a side portion of the headwear material than other sides of the material. The aperture size is adjustable so as to permit the headwear material to be fixable to the hat about the headband region of the hat and to leave the crown of the hat uncovered by the material. This arrangement allows for the remainder of the material to depend from the hat and fall below the headband of the hat about the head of the wearer of the hat.

Headwear for partially covering a hat, the hat having a headband region, the headwear comprising preferably a single piece of material of an irregular shape comprising an aperture located closer to a side portion of the headwear material than other sides of the material, and the aperture size being adjustable so as to permit the headwear material to be fixable to the hat about the headband region of the hat, allowing for the remainder of the material to depend from the hat and fall below the headband of the hat about the head of the wearer of the hat and adapted to attach to a clothing garment. The attachment may be by buttons located on the garment and button holes in the headwear. Another arrangement is the use of hook material and eye material respectively located on the headwear and garment.

A clothing garment having a hood, the hood for partially covering a hat, the hat having a headband region, the hood comprising a hood material of an irregular shape comprising an aperture located in a portion of the hood material which is located closer to a side portion of the hood material than other sides of the hood material, and the aperture size being adjustable so as to permit the hood material to be fixable to the hat about the headband region of the hat, to leave the crown of the hat uncovered by the material allowing the remainder of the hood material to depend from the hat and fall below the headband of the hat about the head of the wearer of the hat.

In one preferred aspect, the present disclosure includes a clothing garment having a shoulder region with a neck opening; and a hood integrally formed around the neck opening. The hood is movable between an undeployed position where the hood rests around the shoulder region when worn, and a deployed position where the hood is vertically extended above the shoulder region when worn. The hood has a first aperture with a complete perimeter configured to expose a face of a wearer while the hood is in the deployed position. The hood has a second aperture with a complete perimeter configured to expose a crown of a hat while the hood is in the deployed position. A majority of the hood is located below a headband region of the hat while the hood is in the deployed position. The first aperture and the second aperture are spaced apart from one another in the deployed position, creating a brim covering region. The perimeter of the first aperture forming the brim covering region has a curve in a flat orientation that parallels a curve of the perimeter of the second aperture that forms the brim coving region while said second aperture is in the expanded configuration. The second aperture has a diameter in an expanded configuration that is greater than a diameter of the neck opening of the clothing garment.

Throughout this specification and the claims that follow unless the context requires otherwise, the words 'comprise' and 'include' and variations such as 'comprising' and 'including' will be understood to imply the inclusion of a stated integer or group of integers but not the exclusion of any other integer or group of integers.

The reference to any background or prior art in this specification is not, and should not be taken as, an acknowledgment or any form of suggestion that such background or prior art forms part of the common general knowledge.

Suggestions and descriptions of other embodiments may be included within the disclosure but they may not be illustrated in the accompanying figures or alternatively features of the disclosure may be shown in the figures but not described in the specification.

Although the foregoing embodiments have been described in some detail for purposes of clarity of understanding, it will be apparent that certain changes and modifications may be practiced within the scope of the appended claims. It should be noted that there are many alternative ways of implementing both the process and apparatus of the present embodiments. Accordingly, the present embodiments are to be considered as illustrative and not restrictive, and are not to be limited to the details given herein, but may be modified within the scope and equivalents of the appended claims.

DETAILED DESCRIPTIONS OF THE INVENTION

Figure 1:
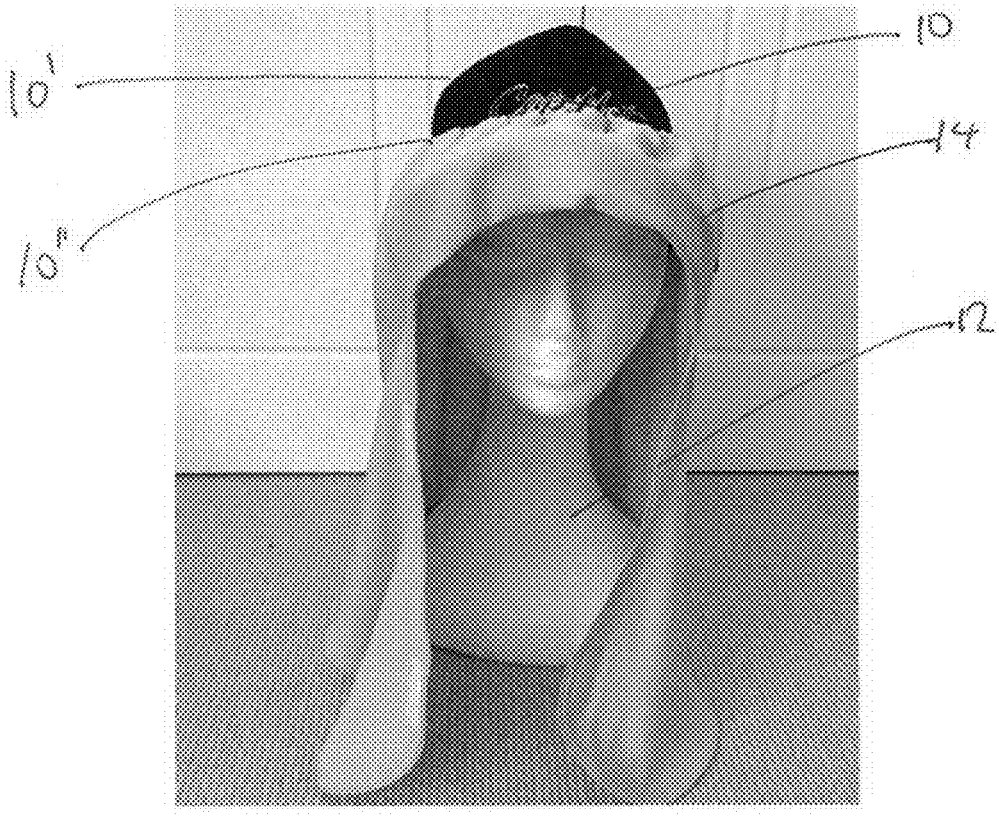
FIG. 1 depicts a front view of a cap on the head of a person over which is located an embodiment of the headwear.

The wearing of hats as headwear is very popular.

There many types of headwear and caps are just one of the over 100 types of headwear that are used all over the world. Caps and in particular, so called 'baseball' caps are very popular and they have an almost standard shape and configuration. FIGS. 1 to 6 depict a cap and an embodiment of a type of additional headwear is depicted in those Figures which is particularly suited to being worn with a cap. However, the elements of the embodiment of the type of additional headwear described in detail in this specification are applicable to many of the different types of known hat and headwear as will be illustrated in the further embodiments described in this specification.

Caps have a crown portion which covers the top portion of the head of the wearer. The crown may be made of two or more (typically 6) parts joined together. Since the parts are typically made of fabric they are sewn together. The parts of the crown may all be of the same material or some of them may be of different material or form, such as for example, the parts formed from cloth material or plastic mesh, the later to specifically facilitate air circulation within the crown of the cap. The shape of the crown can vary according to the style or function of the cap. The crown of the cap is also the location of the main colour or colours of the cap which can have certain significance to the wearer and is often in the case of caps worn to sporting events, recreationally or even in some work places. The colours displayed by the cap may be representative of the sporting team followed by the wearer and thus readily identifies the wearer as a team follower to others. The crown is also the location for logos and words that are sometimes the brand of the cap, a sporting team name and/or logo, a company name or logo, etc. the location of which can be anywhere on the crown of the cap that is visible while being worn.

The peak of the crown of the cap is optionally terminated by a button (known also as a squatcho or squatchee or skwatch) or similar structure. The button may protect the location below which is the junction of the two or more parts which form the crown of the cap but it is mainly decorative.

Caps will also be made to allow for the size of the head of purchaser and as such since head sizes vary (by way of example, ranging from 54.9 centimetres to 65.4 centimetres/12 and ⅝ inches to 25 and ¾ inches in circumference) the size of the cap is thus defined by the size of the headband portion of the cap. It may be that the headband of the cap will be made to adjust to a range of head sizes there may in fact be three or four ranges which themselves may vary depending on the style of cap. Further since the cap may be worn at different locations on the head the sizing may be chosen to suit the maximum circumference of the way in which the wearer decides to wear the cap (in one example the cap is worn tilted and the head band will need to be larger and sometimes small than if the cap were worn with a horizontal orientation).

To facilitate the securement of the cap to the head of the wearer there are a number of ways to comfortably tighten the headband portion of the cap and sometimes the style of securement is as important as the functionality.

Caps will also typically have a visor/peak (herein referred to as a peak) that is attached to the crown portion of the cap at the nominal front of the cap and typically below the headband portion depending from the cap and forming a shelf above the eyes of the wearer, typically to shade the eyes and parts of the face of the wearer from the sun. There are a variety of peak types as well, including a flat peak, a curved peak, short and long version of the flat and curved peaks, etc. It is however, well known that the cap and its peak do not protect the wearer from al the adverse effects of sun, rain and the cold.

An embodiment of one aspect of headwear for partially covering a hat, such as a cap, where the cap has a crown and a headband region is depicted in FIGS. 1 to 6. The numerals used in the FIGS. 1 to 6 to depict features and a particular numeral is used to depict the same feature when illustrated in each figure. The term hat is used to express the broadest form of the headwear over which the embodiment can be used but in this embodiment a cap is the type of headwear used as an example.

The headwear for partially covering a cap and for covering the person wearing the cap, is made of material, examples being cotton, polyester, etc., which preferably has a tightness of weave or knit wherein the tighter the better the sun blocking rating, some stretch but limited stretch is provided as it may lower the sun blocking rating (also sometimes referred to as the Sun Protection Factor (SPF). The material of the headwear may also be moisture repellent since the absorption of moisture may lower the sun blocking rating. The headwear material may be integrally manufactured with Ultra Violet radiation absorbing compounds or materials, or be coated with Ultra Violet radiation absorbing compounds. The actual percentage of Ultra Violet radiation blocked can be equated according to known standards to a Ultra Violet protection Factor (UPF), and clearly the higher the better. It will also be useful if the material is light so as to not make the weight carried by the head of the wearer be uncomfortable over time, but not so light that the wind easily displaces it from depending from the cap or hat it is placed over. It will also be useful if the headwear material is a tightly woven or knit so as to minimise the transmission of wind through the material. Flame proof headwear material may also be used for occupational safety reasons.

The headwear has an irregular shape so as to, in use drape from the cap being worn, down to the wearers body, such as across their shoulders about and over their neck and in some cases be drawn across the face of the wearer while still draping as described. A square or rectangular shape may achieve some of those requirements but there will likely be excess material and there will be additional weight and unsightly shaping of the headwear, recognising that there is an aesthetic aspect to headwear in general which can override practical safety aspects of headwear as a choice for a potential wearer.

The headwear has an aperture located in the unitary material at a location which is closer to, in use, the nominal front side of the headwear material than other sides of the material. In a general sense the aperture is located in a portion of the material which is located closer to a side portion of the headwear material than other sides of the material. The positioning of the aperture facilitates that least an area of the material is located over the peak of a cap, which will then provide a clear view for the wearer of the cap, assuming that the peak is worn to the front of the head of the wearer. The same principle applies when locating the aperture in the headwear when it is to be used with a broad brimmed hat, so that the least material of the headwear is located above the face of the wearer of the headwear and the majority of the area of the material of the headwear is located below the headband region of the cap, in this embodiment or hat in general, and that the depending from the cap towards and over the shoulders and covering the neck of the wearer of the cap and headwear.

The aperture is made by cutting the material large enough to allow the means to provide adjustability to also be created out of the material, in which case the size of the aperture is smaller than the final size, so excess material can be used to form a channel for the placement of a cord therein allowing for its free ends to be joined in some manner. The aperture may be cut from the material, which itself is elasticised and if required the cut it finished off by sewing or some other acceptable method. The final size of the provided aperture is adjustable so as to permit the hood material to be fixable to the cap, in use, about the headband region of the cap. The adjustability of the size of the aperture accommodates different sized caps, either within a predetermined range or more than one range, or will be useable with all sizes of caps.

The adjustability of the aperture can be provided in many forms. One such form is the use of a length of cord which is located in a channel sewn into the periphery of the aperture and which, in this form, defines and creates the aperture in the material. The two free ends of the cord are available external of the channel and they can be joined together when the tightness required to engage the headband region of the cap is suitable, without unduly (as determined by the wearer) adding to the tightness of the cap. The joining of the free ends of the cord can be achieved by tying them together or by using a toggle that releasably engages one or both cord ends. There are many such toggles available to use which vary in colour, size and ease of use and it is a design choice to select one of those available. The use of a cord is but one way to provide an adjustable feature to the aperture.

Another way and which in to form, define and create an aperture in the headwear material, is to provide an elastic material either in the material which is the headwear or added to the headwear material. The elastic portion being sufficient to achieve the fixing of the headwear material of the headwear to the cap or hat but to not be so tight as to be noticeable by the wearer of the cap/hat and headwear. Yet another way in which to provide adjustability of the aperture size is to provide the same or similar adjustable mechanism, one such way is to provide two plastic strips about a part of the aperture which may not extend the full circumference of the aperture; the first of the strips having a row of equal sized apertures positioned along the longitudinal axis of the strip, and the second of the strips having at least one protuberance sized to interference fit inside an aperture also located along the longitudinal axis of the strip located on the side facing the other strip. The aperture is then sized to the wearers head by placing the protuberance into the aperture closest to the protuberance while the plastic strips are over lapping and the headwear is comfortably fitted to the cap on the head of the wearer.

An alternative securement is the use of elastic, fully or partially, located about the aperture, but the tension created by the elastic can sometimes be uncomfortable for the wearer.

A yet further alternative securement is the use of strips located along the aperture, the strips being of complementary hook material and eye material which can be releasably attached to each other while being overlapped, while the tension of the headwear over headband region of the cap on the wearer is acceptable and hopefully sufficiently firm to secure the headwear to the cap of the wearer of the cap.

A further alternative securement is the use of a cord threaded through a channel of fabric located about the headband portion of the cap and the two ends of the cord are left free for the wearer of the cap to tighten and tie the ends together so as to hopefully secure the cap to the wearers head. Equally there is a variety of releasable cord fixing devices adapted to carry each cord and permit release and engagement of the cords relative to one another, either while in use to fix the material headwear to a hat or just to keep the cords together at one point along their free length.

With the periphery of the aperture as defined by the means to adjust the size of the aperture located about the headband region of the cap, the crown of the cap is exposed/uncovered by the material and the crown of the cap generally lies above the headwear, allowing for the remainder of the material of the headwear to depend from the cap and fall about the head of the wearer of the cap. The exposed/uncovered crown of the cap thus continues to leave exposed the colour/s or the name or the logo thereon.

Figure 2:
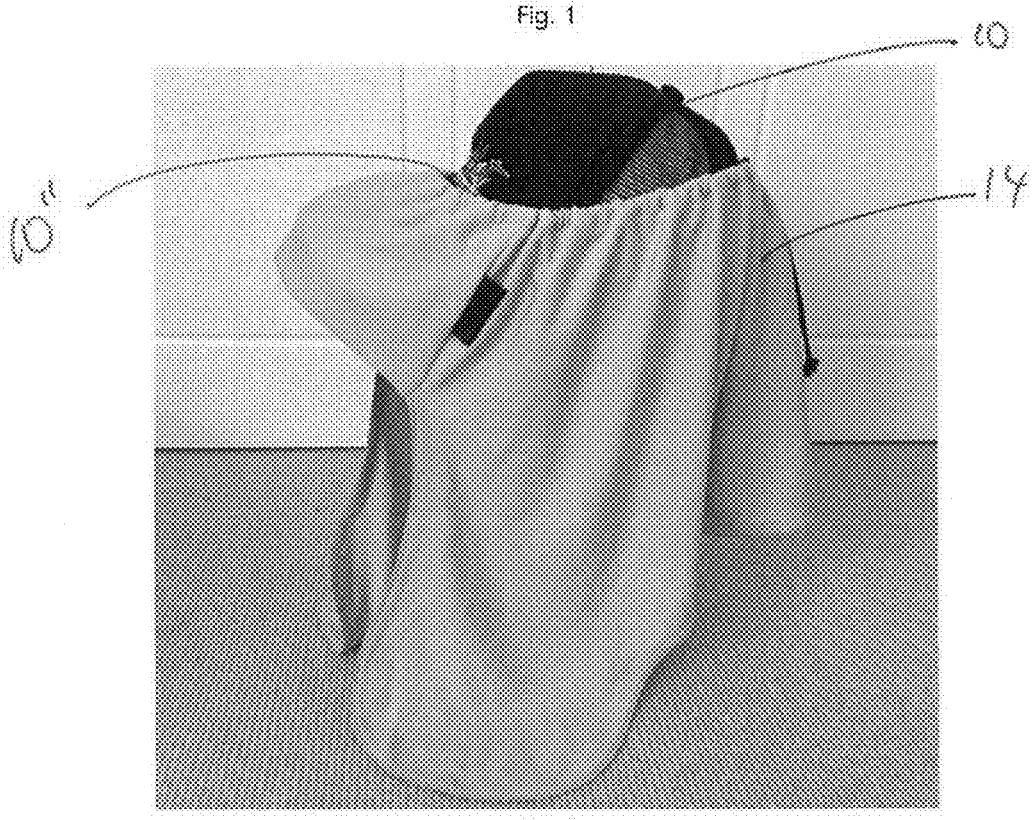
FIG. 2 depicts a side view of the cap and headwear as depicted in FIG. 1.
Figure 3:
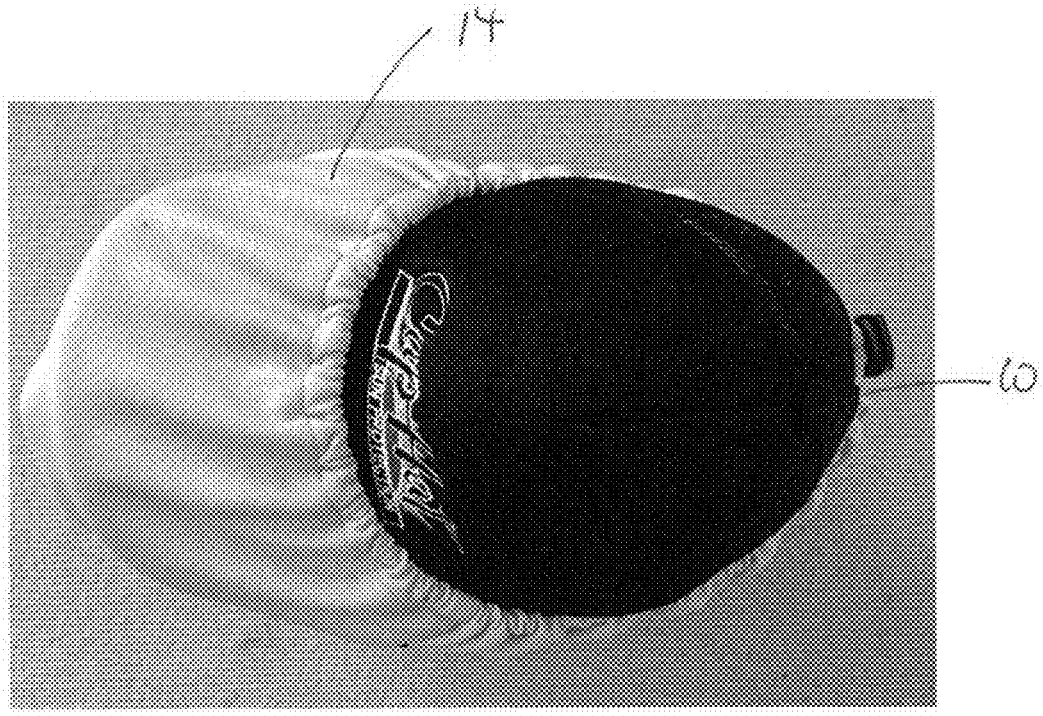
FIG. 3 depicts a top view of the cap and headwear as depicted in FIG. 1.
Figure 4:
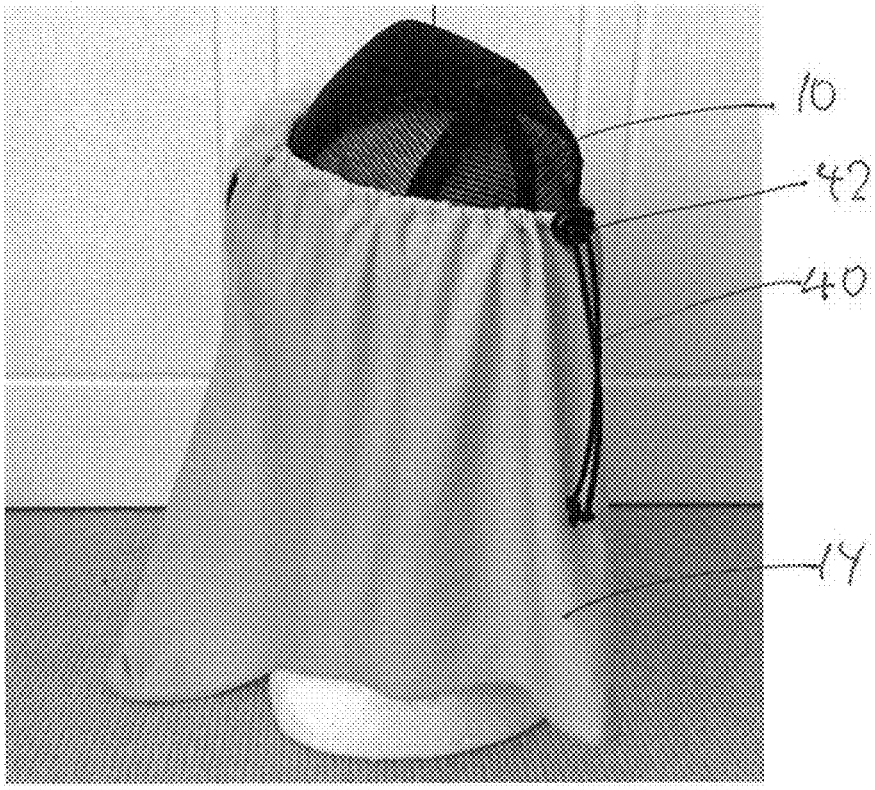
FIG. 4 depicts a rear view of the cap and headwear as depicted in FIG. 1.

FIG. 1 depicts a front view of a cap 10 having a crown portion 10' on the head of a person 12 over which is located an embodiment of the headwear 14. FIG. 2 depicts a side view of the cap and headwear as depicted in FIG. 1. FIG. 3 depicts a top view of the cap and headwear as depicted in FIG. 1. FIG. 4 depicts a rear view of the cap and headwear as depicted in FIG. 1.

Figure 5:
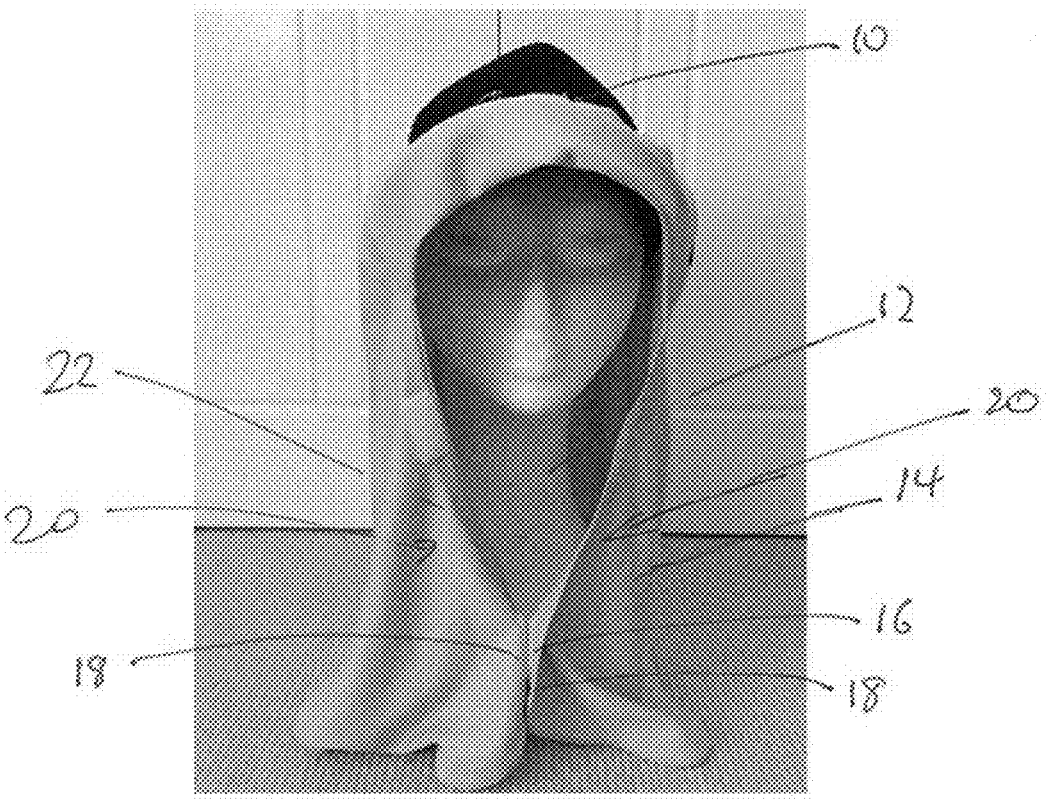
FIG. 5 depicts a front view of the cap and headwear as depicted in FIG. 1 with the front partially closed.

FIG. 5 depicts a front view of the cap and headwear as depicted in FIG. 1 with the front partially closed. The closure of the front of the headwear is achieved using an attachable and releasable hook material 16 and eye material 18 respectively located near the periphery 18 of the material 14 located low below the cap and which although not ideal for all wearers, will allow the sides of the depending material 20 to be stopped from flapping in light winds as well as locating the material across at least a portion of the neck 22 of the wearer.

Figure 6:
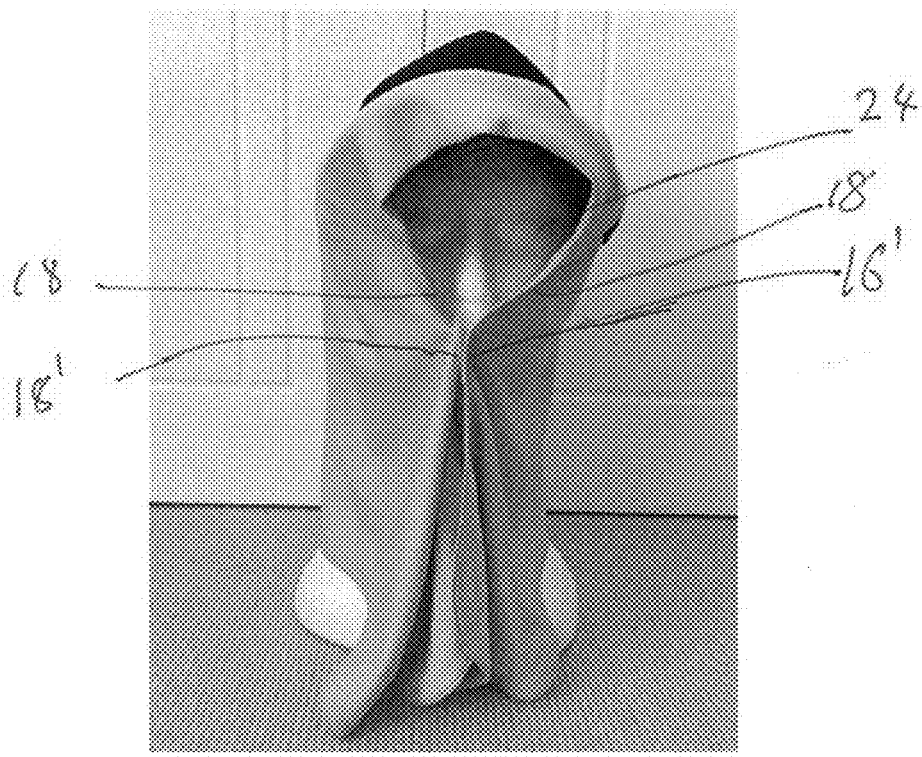
FIG. 6 depicts a front view of the cap and headwear as depicted in FIG. 1 with the front of the headwear closed more fully than depicted in FIG. 5.

FIG. 6 depicts a front view of the cap 10 and headwear 14 as depicted in FIG. 1 with the front of the headwear closed more fully than depicted in FIG. 5, using a second attachable and releasable hook material 16' and eye material 18' respectively locate on the periphery 18 of the material located just below the peak of the cap and which although not ideal for all wearer, will allow the sides of the depending material to be stopped from flapping in strong winds as well as locating the material across the majority of the neck and the lower portion of the face 24 of the wearer. FIG. 6 depicts the exposure of just the eyes of the wearer and can in some cases cover the nose of the wearer to minimise the ingress of dust into the area of the face of the wearer, while providing good coverage of the neck and shoulders of the wearer.

Also depicted is the exposed/uncovered crown portion 10' of the cap 10 while the headwear 14 is fixed to the cap. The fixing of the headwear to the cap is achieved in this embodiment by the use of a cord 40 and a toggle 42 arrangement, like that described above. The cord and toggle arrangement provides adjustability of the aperture 15 defined by the cord path in a channel of material formed in the periphery of the aperture in the headwear. As described previously the size of the aperture is determined by the means of adjustment and the maximum size to which the aperture needs to be created for use. In use, the adjustable aperture of the headwear is located approximately about the headband region 10" of the cap (not explicitly shown) but which as described previously is located at the base of the crown of the cap and above or at the location where the peak connects to the crown of the cap. FIG. 4 appears to show the aperture forming arrangement fixed to a location somewhat higher than the headband region of the cap and that is always a possibility but in any event the fixing is sufficiently secure to satisfy the wearer of the cap and added headwear and is a result of the adjustability feature of the aperture in the headwear rather than having a fixed version of the aperture.

The headwear is irregularly shaped to suit its use with a cap such that the length that the material of the headwear depends from the cap is arranged to lie on or near the shoulders (not shown) of the wearer but provide of excess material of the headwear near the front of the wearer as shown in FIGS. 1, 2, 5 and 6. The headwear may be shaped to suit all manner of hats. One example of a unique hat is a hard hat used for safety reasons and in many cases required to be worn in certain environments, such as a construction or mining site but which is known to be deficient in their ability to protect the wearer from the sun, wind and sometimes insects and sand. Other hat types, such as a pith helmet and ten-gallon hats, although of very different shape can still be worn with the hats described when the shape of the headwear is made to accommodate the different types and sizes of brim or is designed to suit a variety of different hats but not all of them.

Figure 7:
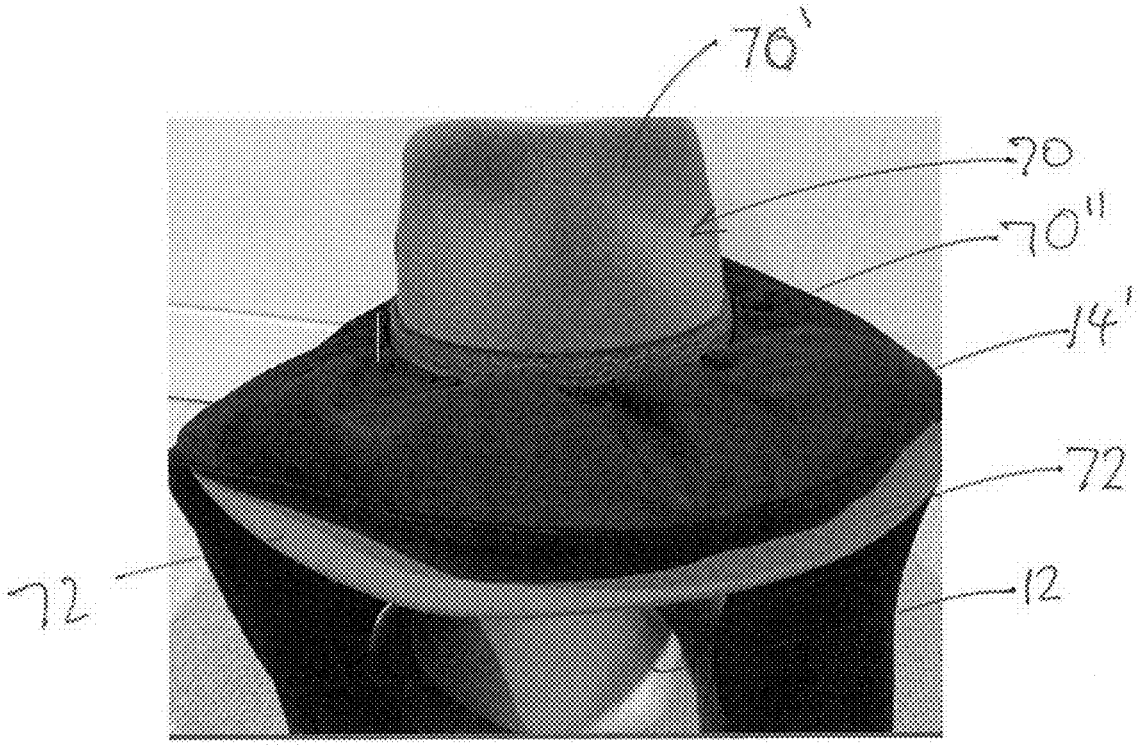
FIG. 7 depicts a front view of a hat on the head of a person over which is located a further embodiment of the headwear.

FIG. 7 depicts a front view of a hat 70 having a crown portion 10' and a headband portion 70" located on the head of a person 12 over which is located a further embodiment of the headwear 14'. In this embodiment the hat is different to the cap previously described in that there is a circumferential brim 72. The crown of the hat which is a different shape to that of a cap as described previously. In this case, and by way of example only, the hat depicted is made of compressed rabbit fur which is treated and made stiff and as a consequence it is long wearing, water resistant to a degree, holds its shape in adverse weather conditions and over time, and the stiffness of the crown supports a wide brim which affords greater sun protection about the full circumference of the hat, certainly more than the peak of a cap (as depicted in FIGS. 1 to 6). The hat has a headband region which in this example is adorned by a separate leather band. The band not only adorns the hat but also limits the expansion of the internal headband circumference; although leather is known to stretch in certain circumstances and over time so the limitation is qualified and limited.

FIG. 7 also depicts the headwear 14' for partially covering the hat. As described the hat has a headband region. The headwear comprises material of an irregular shape comprising an aperture 15' located in a portion of the material of the headwear 14' which is located closer to, in use on a hat to be worn, the nominal front side of the headwear material than other sides of the material. The possible characteristics of the material of the headwear are as described previously in this specification.

The size of the aperture 15' is adjustable so as to permit the hood material to be fixable to the hat 70, in use, about the headband region 70" of the hat. In this embodiment, a cord 40 and toggle 42 are used to fix the aperture to the hat and the ends of the cord are shown in FIG. 8 depending over the brim of the hat over a top surface of the material of the headwear.

The remainder of the material of the headwear 14' not laying on the brim 72 (which clearly is not the aperture) thereby depends from the hat and falls about the head of the wearerl 2 of the hat over, in this embodiment the broad brim of the hat, but not the front portion of the hat, in use. Therefore, the quantity of the material is greater in the embodiment described in connection with FIGS. 7 to 14 than the embodiment described in connection with FIGS. 1 to 6.

Figure 8:
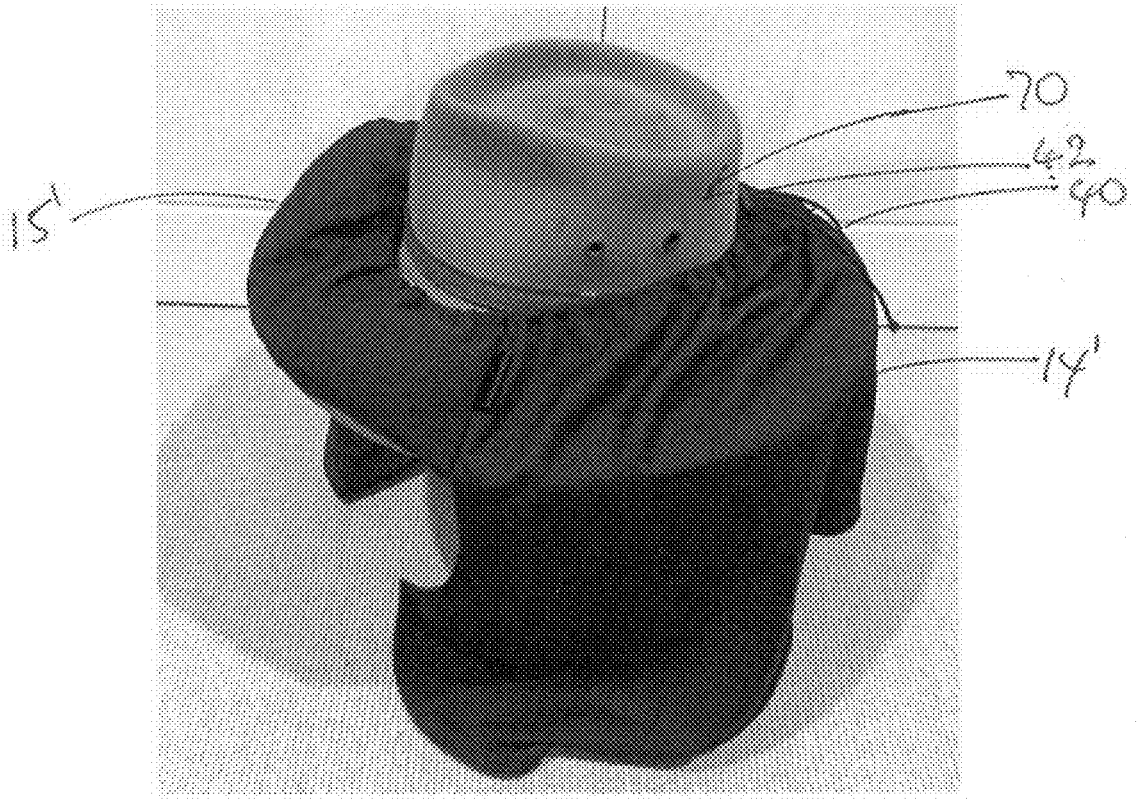
FIG. 8 depicts a side view of the hat and headwear as depicted in FIG. 7.
Figure 9:
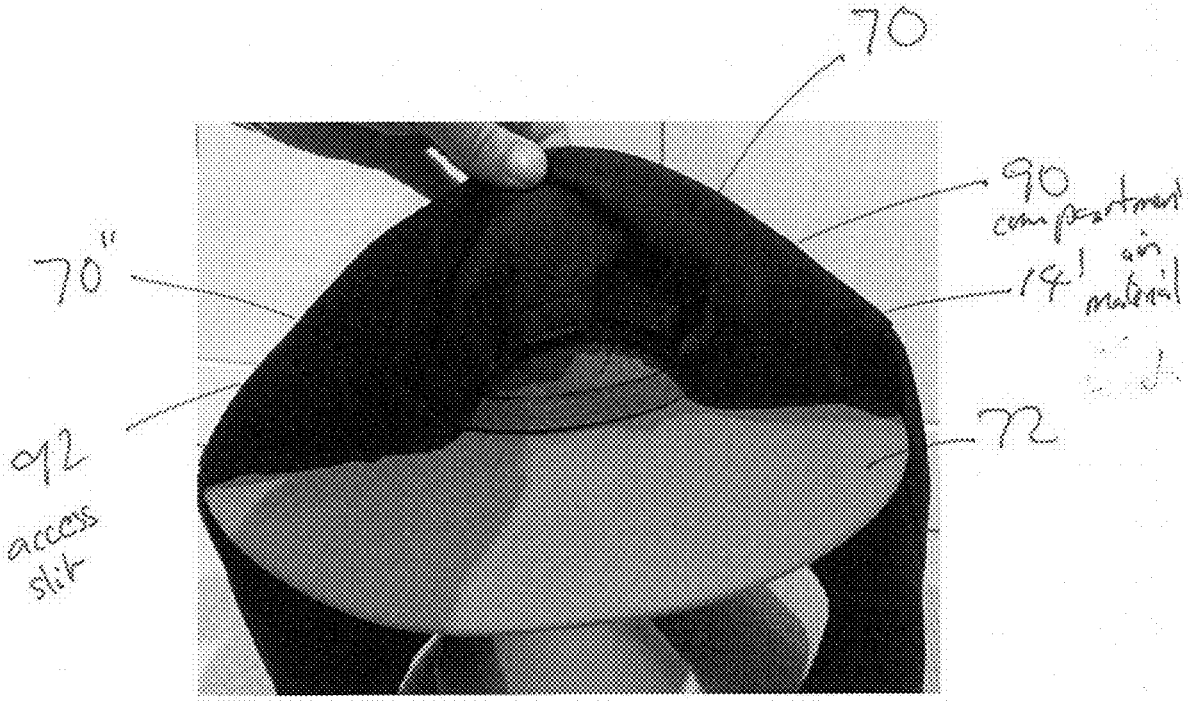
FIG. 9 depicts a front view of the hat and headwear as depicted in FIG. 7 with a netting compartment raised to expose an access to the compartment.
Figure 13:
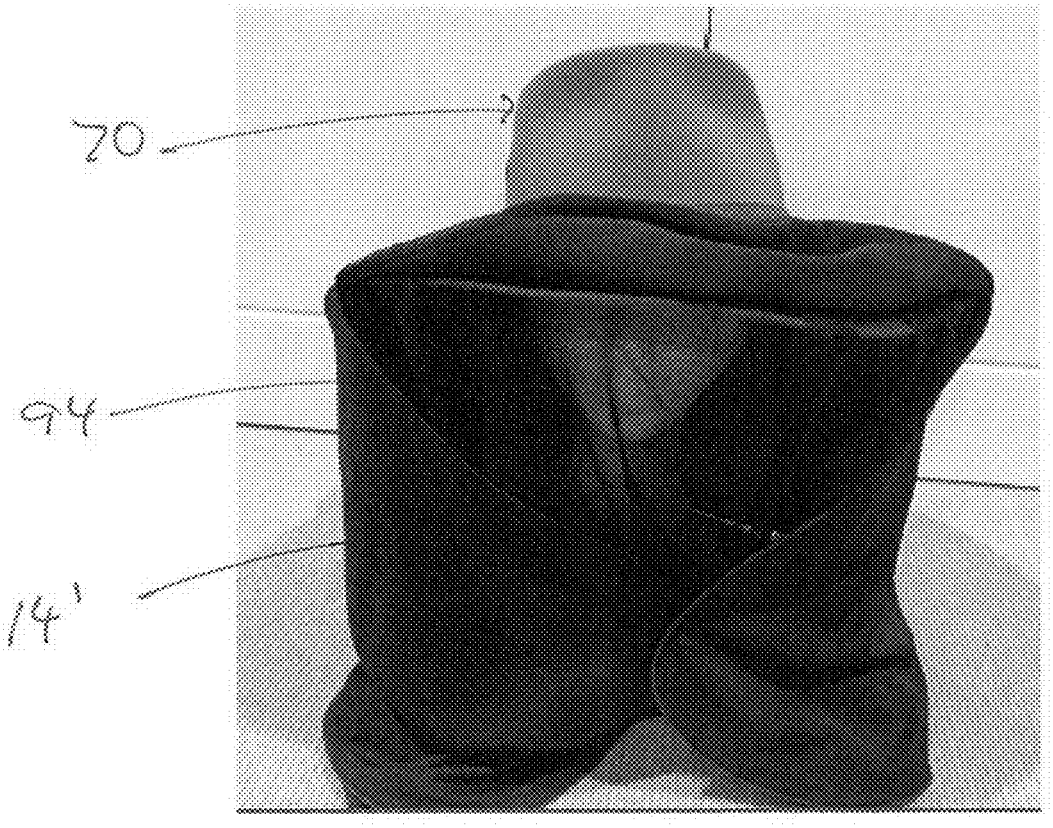
FIG. 13 depicts a front view of the hat and headwear as depicted in FIG. 7 with the netting fully extracted from the compartment depicted in FIG. 9 and located and retained by the headwear so as to protect the wearer.
Figure 14:
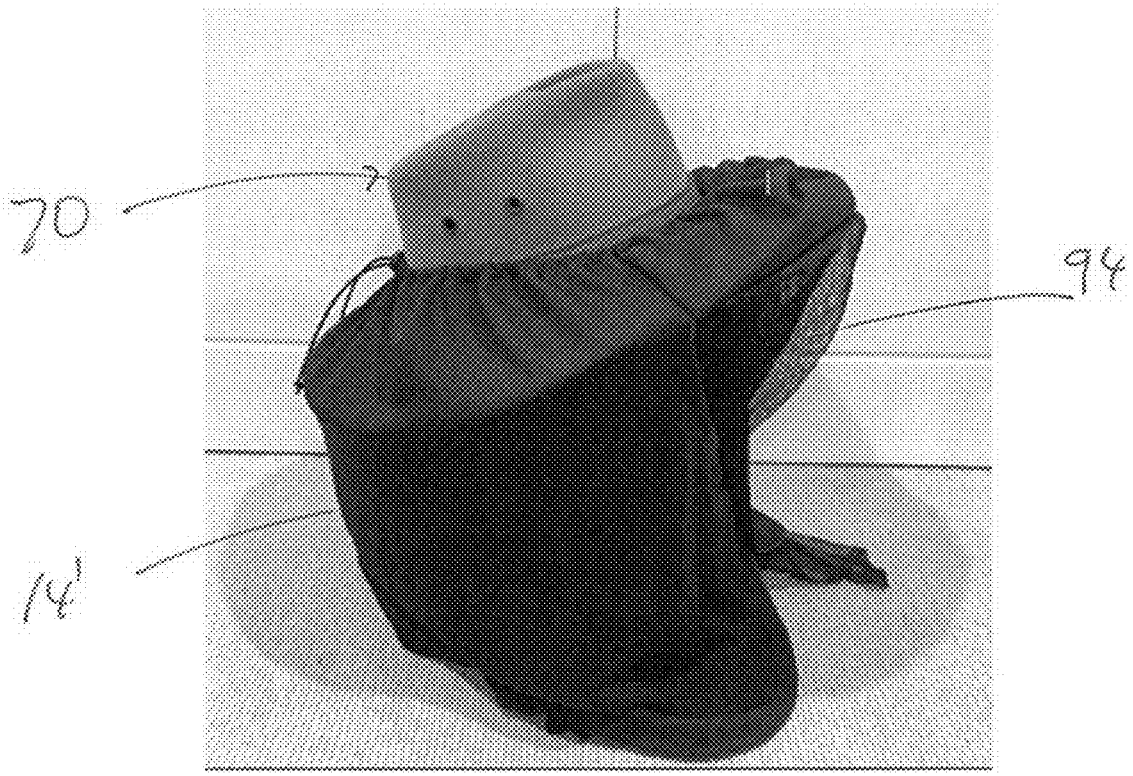
FIG. 14 depicts a side view of the hat and headwear as depicted in FIG. 13.

FIG. 8 depicts a side view of the hat and headwear as depicted in FIG. 7;

FIG. 9 depicts a front view of the hat and headwear as depicted in FIG. 7 with a netting compartment 90 located above the front of the hat in the material of the headwear 14', raised to expose an access 92 to the compartment. The compartment contains a net material 94 (shown in FIG. 10) and the access to the compartment is provided by the use of attachable and releasable hook material 96 and eye material 98 (not shown) attached on respective sides of the access location. A simple separation of the hook material from the eye material allows the enclosed netting 94 to be removed by being pulled from the compartment. The netting is thus available for positioning over the face of the wearer of the headwear, as is depicted in FIGS. 13 and 14. There are a number of alternative arrangements for housing a netting material but the embodiment shown and described is convenient and easily accessed by the user, even while wearing the hat and headwear.

Figure 10:
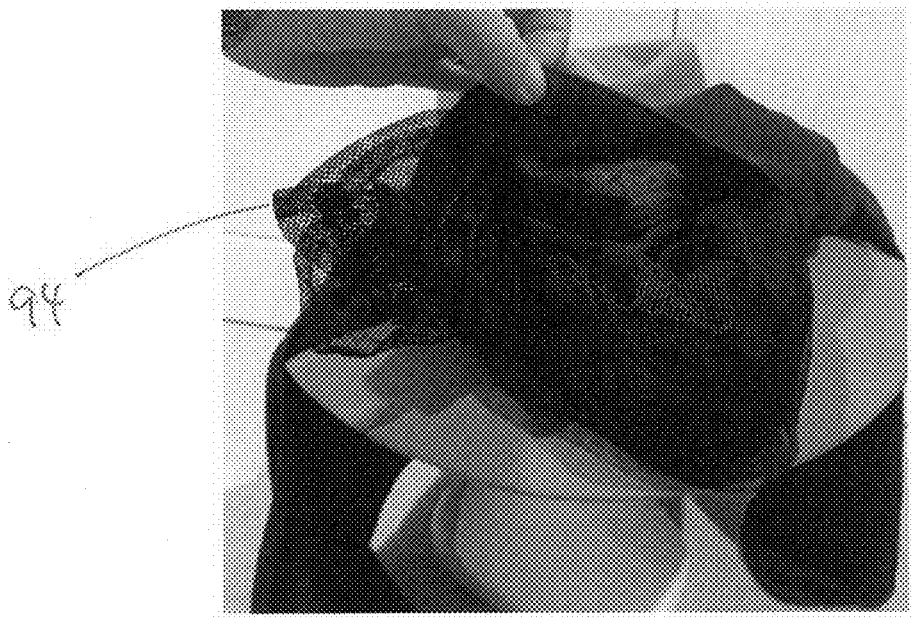
FIG. 10 depicts a front view of the hat and headwear as depicted in FIG. 7 with the netting partially extracted from the compartment depicted in FIG. 9.

FIG. 10 depicts a front view of the hat 70 and headwear 14' as depicted in FIG. 7 with the netting 94 partially extracted from the compartment 90 depicted in FIG. 9.

Figure 11:
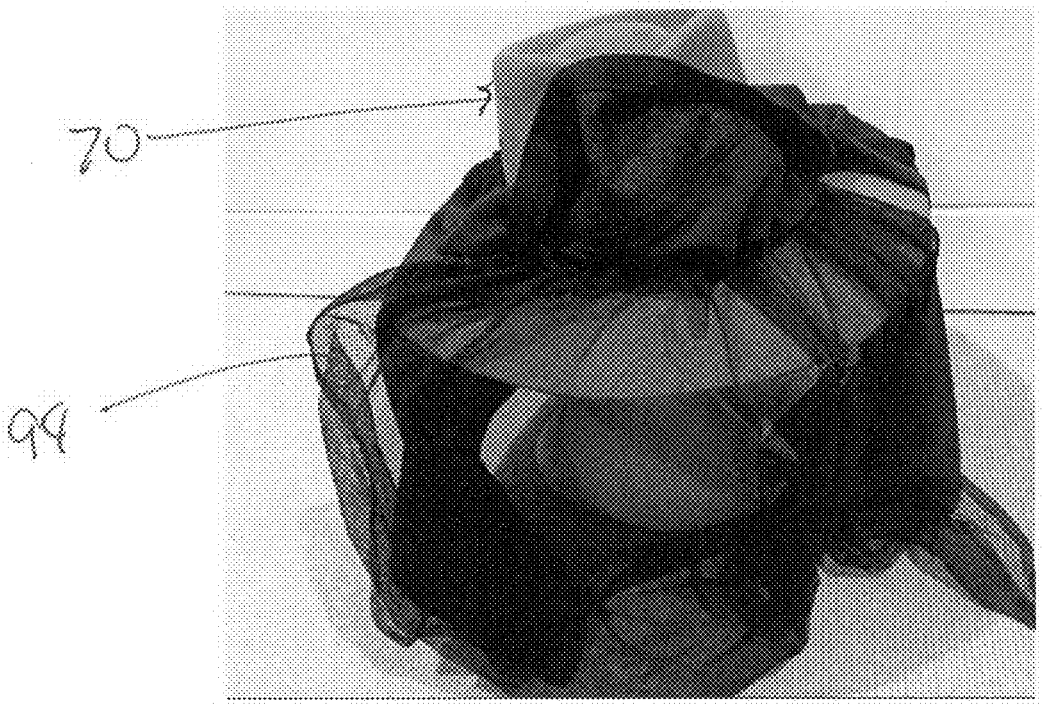
FIG. 11 depicts a front view of the hat and headwear as depicted in FIG. 7 with the netting fully extracted from the compartment depicted in FIG. 9.

FIG. 11 depicts a front view of the hat 70 and headwear 15' as depicted in FIG. 7 with the netting 94 fully extracted from the compartment 90 depicted in FIG. 9, ready for positioning across the face of the wearer to protect them from flying insects and in some circumstances airborne sand, while still allowing air to circulate about the face of the wearer.

Figure 12:
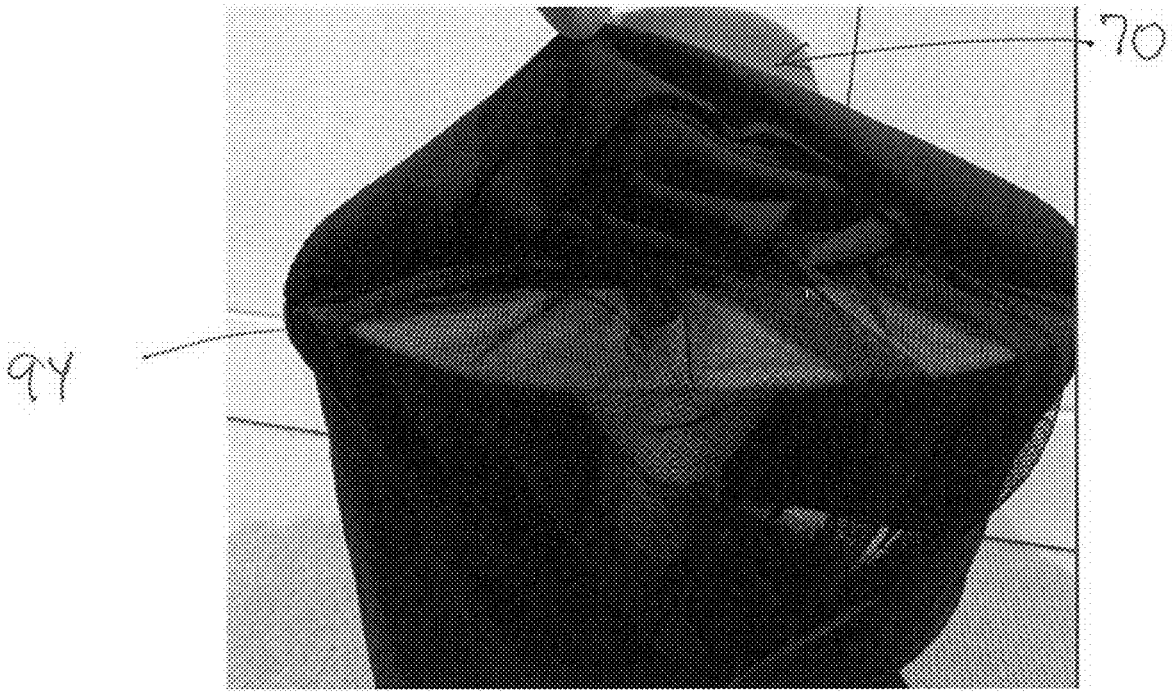
FIG. 12 depicts a front view of the hat and headwear as depicted in FIG. 7 with the netting fully extracted from the compartment depicted in FIG. 9 and with the front portion of the headwear raised to show the access to the compartment.

FIG. 12 depicts a front view of the hat 70 and headwear 14' as depicted in FIG. 7 with the netting 94 fully extracted from the compartment 90 depicted in FIG. 9 and with the front portion of the headwear 14' raised to show the access 92 to the compartment 90.

FIG. 13 depicts a front view of the hat 70 and headwear 14' as depicted in FIG. 7 with the netting fully removed/extracted from the compartment depicted in FIG. 9 and located in front of the face of the wearer and retained by the headwear so as to protect the wearer from flying insects and airborne sand. Such an arrangement of compartment and netting can also be applied to other embodiments of headwear as well as the hood version as described and depicted in this specification for much the same functional reasons.

FIG. 14 depicts a side view of the hat 70 and headwear 14' as depicted in FIG. 13.

Figure 15:
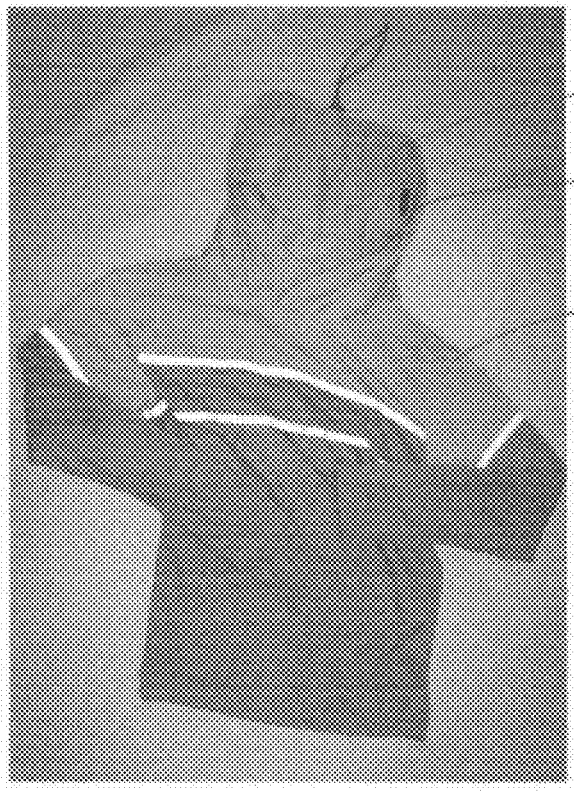
FIG. 15 depicts a front view of a clothing garment incorporate with a further embodiment of the headwear.

FIG. 15 depicts an embodiment which incorporates an aperture 15" into a hood 150 or hoodie of an article of clothing such as a sweatshirt/shirt 152 although it is possible for the embodiment to be incorporated into a separate hood which is adapted to attach to a clothing garment and which is preferably releasably attachable to a coat or sweatshirt or other suitable article of clothing. Indeed the headwear depicted in FIGS. 1 to 6 could be readily adapted to be releasably attachable to a suitable article of clothing by, in one example, providing one part of a two part fixing to selected points of the lower periphery of the headwear material to a clothing garment along at least a portion of a side of the headwear material, such that the fixing location matches a complementary fixing on the article of clothing, say for example, a coat. Thus the headwear becomes part of the clothing and acts much like a hoodie. Attachable hoods for coats exist but less so hoodies which are typically permanently attached to and therefore integral to the sweatshirt/shirt or other suitable article of clothing.

Figure 16:
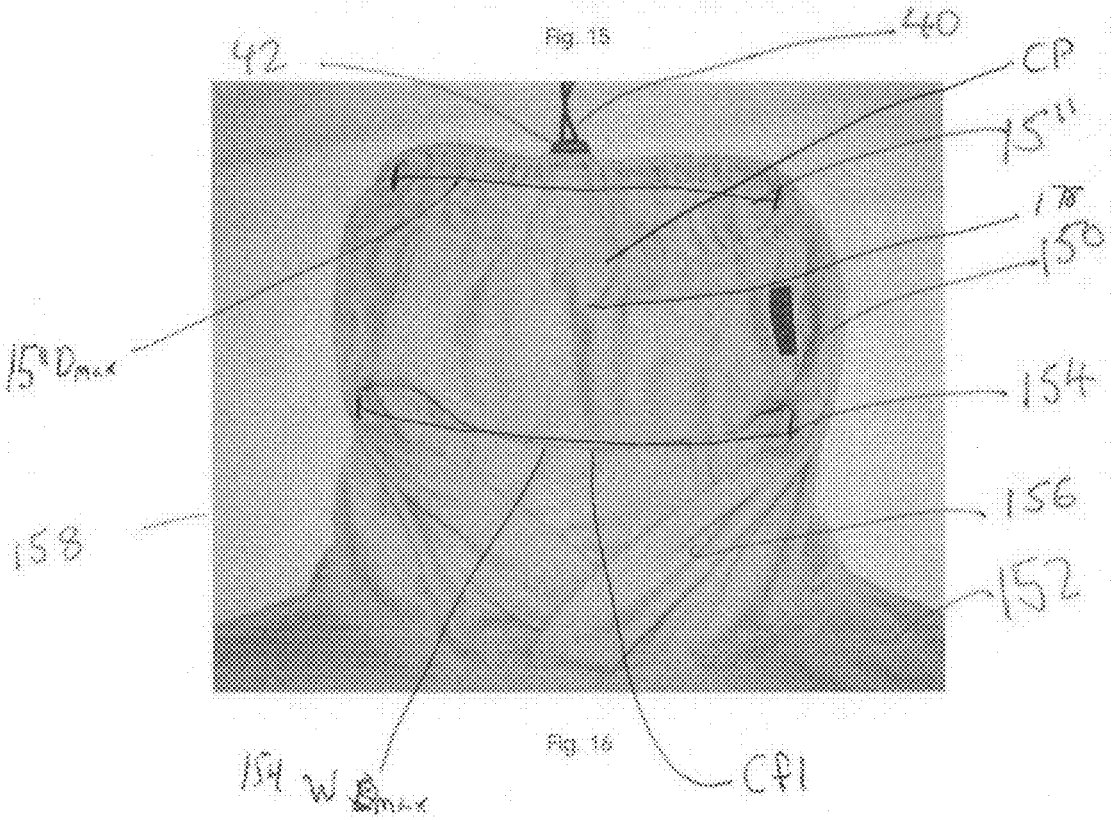
FIG. 16 depicts a close-up front view of the headwear depicted in FIG. 15.

FIG. 16 depicts a close-up front view of an embodiment of the headwear hood 150 depicted in FIG. 15. The aperture 15" is adjustable in size since it is formed by an adjustable arrangement for fixing of the headwear to a cap (a cap is most typically the type of hat a person would wear when wearing a sweatshirt). This does not in any way limit the use of the headwear hood to caps only. The size and configuration of the headwear has previously been described as variable to suit different hats (of which there are over 100 types) and this will also be the case in the headwear hood embodiment.

Adjustability of the size of the aperture, in one embodiment, is achieved, by the use of a cord 40 and a toggle 42 arrangement, like that described above. The cord and toggle arrangement provides adjustability of the aperture 15" defined by the cord path in a channel of material formed in the periphery of the aperture in the headwear. The adjustable aperture of the headwear is located approximately about the headband region 10" of a cap (not explicitly shown). As described previously the corded aperture is located at the base of the crown of the cap and above or at the location the peak connects to the crown of the cap. The fixing of the hood 150 to a cap will be illustrated in FIGS. 18, 19, 20 and 21.

There may be other arrangements for fixing/attachment of the hood to a cap, just as there may other arrangements for fixing/attachment of the previously described embodiments of headwear to a cap. One such arrangement is to provide one or more a fixing/attachment elements to the cap or hat and a complementary fixing/attachment elements to the hood/headwear such that only portions of the periphery of the hood/headwear is fixed/attached to the cap or hat thus although not all of the periphery of the aperture is fixed/attached there is still a fixed relationship between the hood/headwear and cap or hat. As will be noted the aperture need not be completely adjacent to the headband region of the cap or hat to still perform its function. In these alternative arrangements the aperture size is still adjustable so as to permit the headwear material to be fixable to the hat about the headband region of the hat and to leave the crown of the hat uncovered.

FIG. 16 also depicts that the shape of the hood 150 is such that a further aperture 154 is formed to allow (in use) the wearer of the hooded sweatshirt 150 to see forwardly out of the hood. The degree of coring of the face is a matter of the overlap or no overlap of the front portions (156 and 158) of the hood 150.

Figure 17:
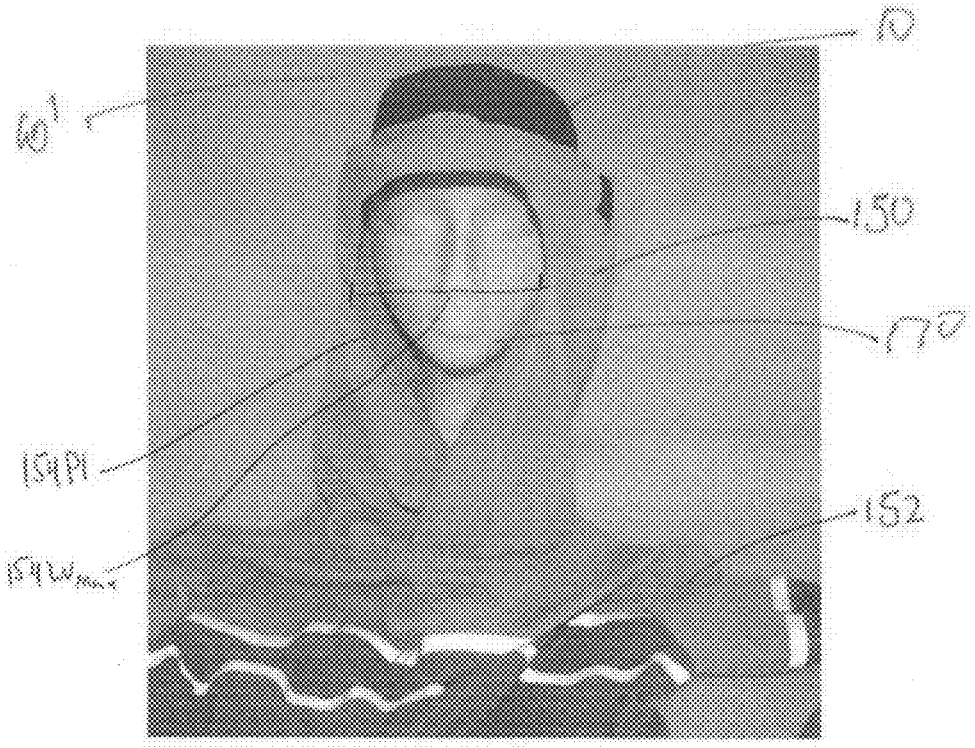
FIG. 17 depicts a front view of the clothing garment and incorporated headwear depicted in FIGS. 15 and 16 on a person wearing a cap as well as the headwear.

FIG. 17 depicts a front view of the clothing garment 152 and incorporated headwear depicted in FIGS. 15 and 16 being worn on a person 170 who is also wearing a cap 10 as well as the headwear hood 150 of the clothing garment. The front view of the wearer is shielded to the sides to protect against sun, wind and rain, while the crown 10' of the cap is still visible.

Figure 18:
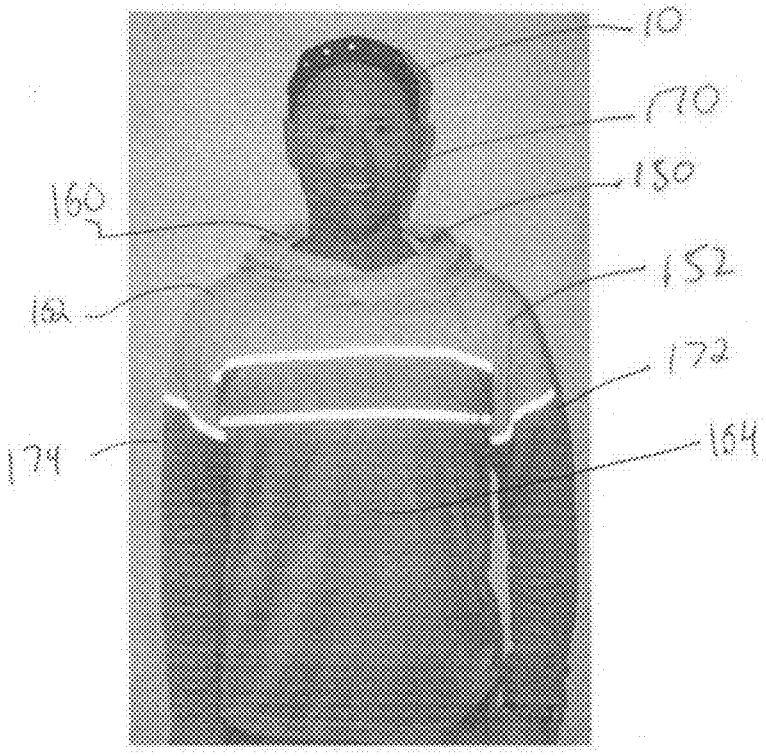
FIG. 18 depicts a front view of the clothing garment and incorporated headwear depicted in FIGS. 15, 16 and 17 being worn on a person and the headwear located about the shoulders and neck of the wearer an undeployed position.

FIG. 18 depicts a front view of the clothing garment 152 and incorporated headwear hood depicted in FIGS. 15, 16 and 17 being worn on a person 170 wearing a cap 10, while the headwear hood 150 is located about the shoulders and neck of the wearer.

Figure 19:
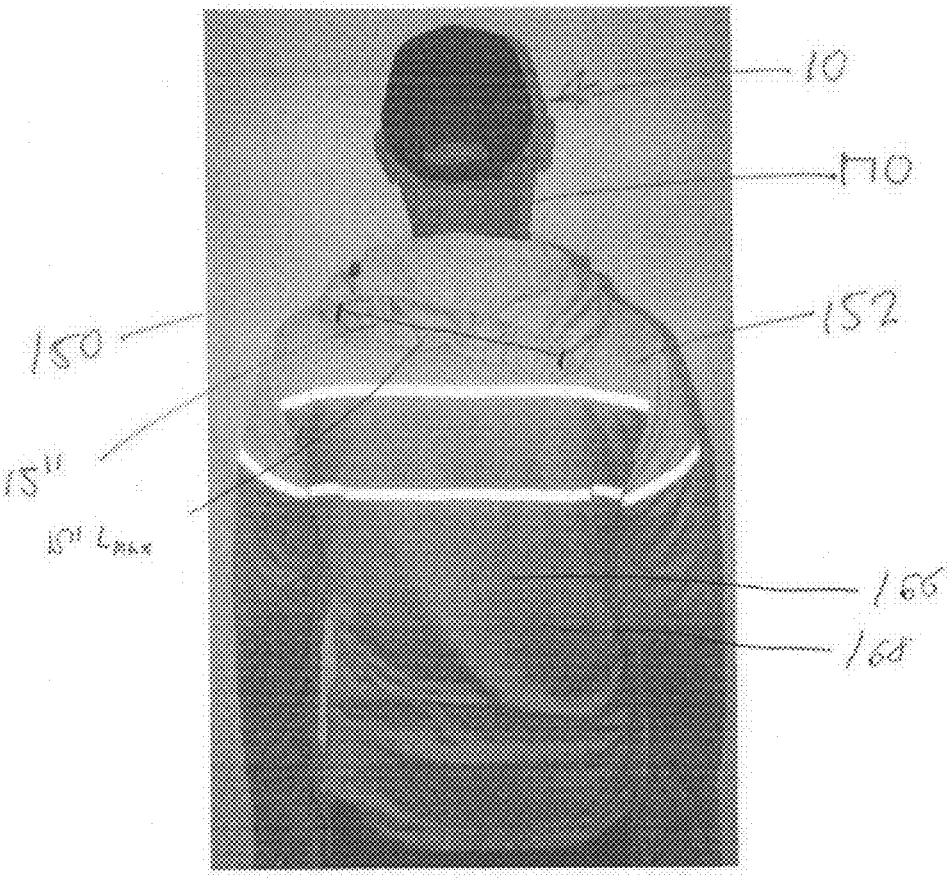
FIG. 19 depicts a rear view of the person wearing the clothing and incorporated headwear.

FIG. 19 depicts a rear view of the person 170 wearing the clothing garment 152 and headwear hood 150 is shown lying across the shoulders of the person 170. The aperture 15" is clearly depicted but the size of the aperture is not minimised and is open but not fully open as gauged by the length of cord 40 lying free of the toggle 42 (depicted best in FIG. 20). The aperture could be minimised when not being worn over a cap by drawing the cord tighter to substantially close the aperture. In that state, the hood of the hooded sweatshirt could be used like a normal hood/hoodie, save for the cord length now external of the channel formed about the aperture and toggle. In such a case there can be a pocket, located preferably internal to the headwear hood, within which the cord can be stored out of sight. Depending on the mechanism to adjust the size of the aperture there will be a variety of way of concealing the mechanism, since aesthetics still matter in most case but not all.

Figure 20:
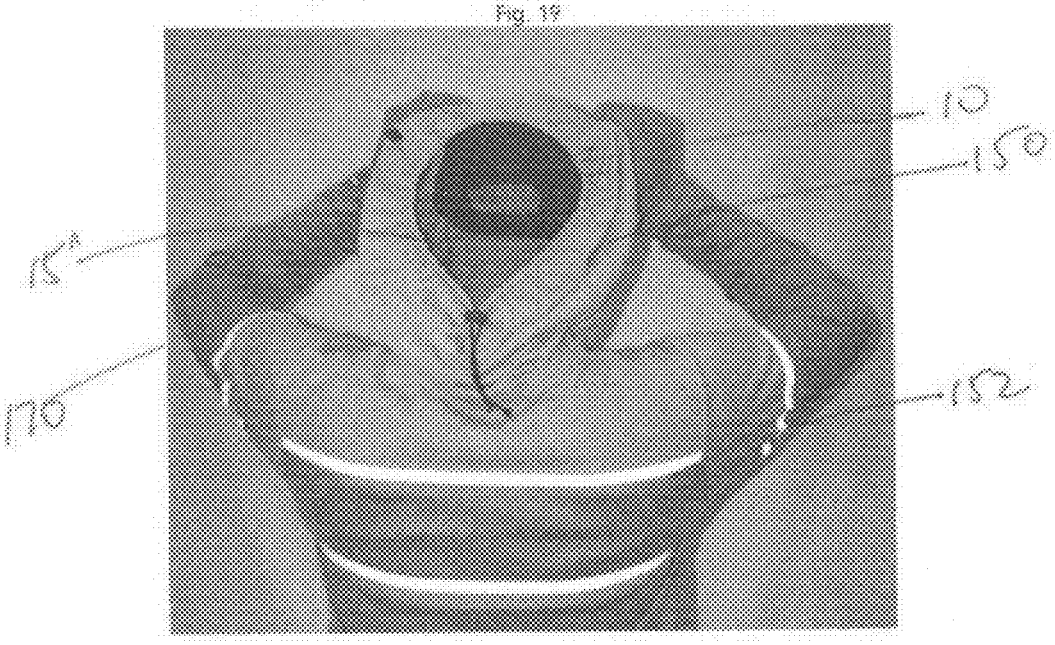
FIG. 20 depicts a rear view of the person wearing the clothing and placing the incorporated headwear partly over the cap.

FIG. 20 depicts a rear view of the person 170 wearing the clothing garment 152 and placing the headwear hood 152 partly over the cap 10.

Figure 21:
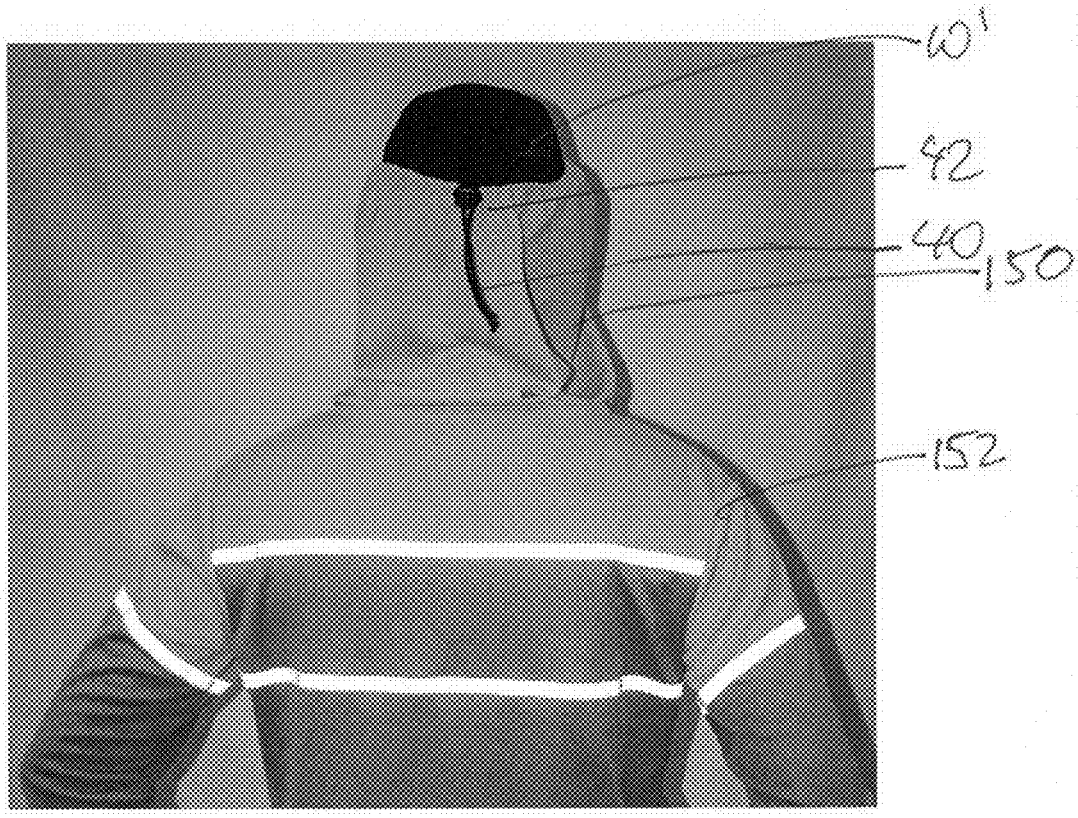
FIG. 21 depicts a rear view of the person wearing the clothing with the incorporated headwear fixed to the cap thus exposing the crown of the cap.

FIG. 21 depicts a rear view of the person 170 wearing the clothing article 152 with the incorporated headwear hood 152 fixed to the cap 10 thus exposing the crown 10' of the cap. Also depicted is a length of cord 40 lying free of the toggle 42 hanging behind the head of the wearer.

Figure 22:
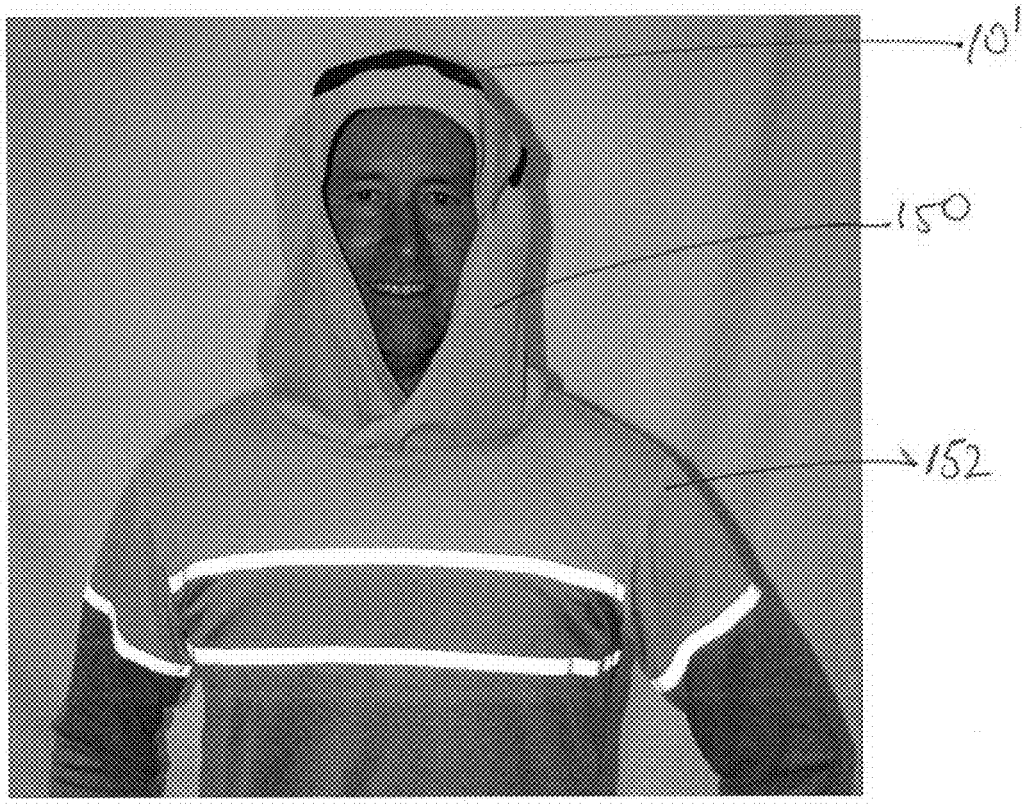
FIG. 22 depicts a front view of the person wearing the clothing with the incorporated headwear fixed to the cap thus exposing the crown of the cap and the face of the person.

FIG. 22 depicts a front view of the person 170 wearing the clothing garment 152 with the incorporated headwear hood 152 fixed to the cap thus exposing the crown 10' of the cap 10 and the face of the person.

Figure 23:
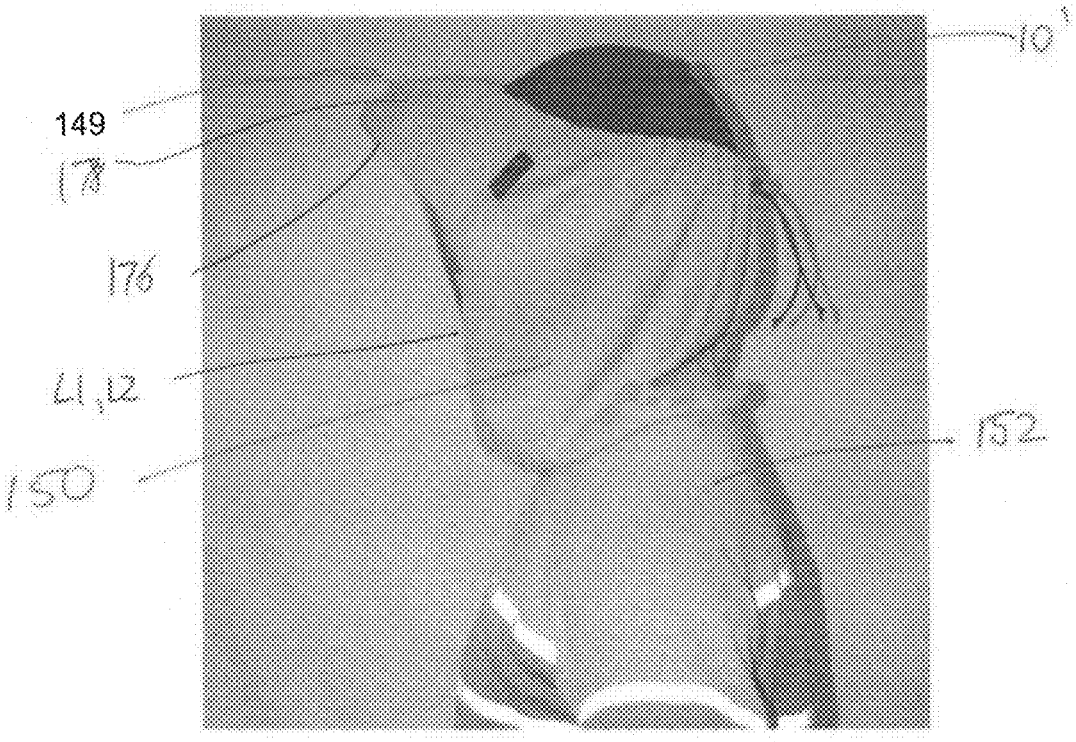
FIG. 23 a side view of the person wearing the clothing with the incorporated headwear fixed to the cap thus exposing the crown of the cap and substantially covering the side of the face of the person, a deployed position.

FIG. 23 a side view of a person wearing the clothing garment 152 with the incorporated headwear hood 152 fixed to the cap thus exposing the crown 10' of the cap 10 and substantially covering the side of the face of the person. The peak of the cap 10 is fully covered by the headwear hood designated by a brim covering region and in this case the hood slightly extends beyond the peak to provide more cover and protection to the wearer than the cap alone would provide, while the hood also extends downwards beside of the face of the wearer so as to provide protection from sun, wind and sand to the face and particularly the eyes of the wearer.

The invention claimed is:

1. A clothing garment for providing sun protection to a wearer of the garment in combination with a hat having a brim, the garment comprising:

a front chest panel configured to cover an entire chest of the wearer;

a rear panel configured to cover an entire back of the wearer;

a left sleeve and a right sleeve, each of said sleeves being configured to cover an arm of the wearer;

a shoulder region with a neck opening, said shoulder region being integrally formed with said front chest panel, said rear panel, and each of said sleeves;

a hood integrally formed around the neck opening, said hood being movable between an undeployed position where said hood rests around the shoulder region when worn, and a deployed position where said hood is vertically extended above the shoulder region when worn, said hood having a first aperture with a complete perimeter configured to expose a face of a wearer while said hood is in the deployed position, said hood having a second aperture with a complete perimeter configured to expose a crown of the hat while said hood is in the deployed position, a majority of said hood being located below a headband region of the hat while said hood is in the deployed position, said first aperture and said second aperture being completely spaced apart from one another in the deployed position, said second aperture having a diameter in an expanded configuration that is greater than a diameter of the neck opening of the clothing garment, said hood including a channel extending completely around the second aperture, said hood including a brim covering region between the perimeter of said first aperture and the perimeter of said second aperture, the perimeter of said first aperture forming said brim covering region having a curve in a flat orientation that parallels a curve of the perimeter of said second aperture that forms said brim covering region while said second aperture is in the expanded configuration; and an aperture size adjusting mechanism configured to adjust a size of said second aperture, said aperture size adjustment mechanism including a cord insertable through said channel, the cord being movable through said channel.

2. The garment of claim 1, wherein said aperture size adjustment mechanism includes a toggle.

3. The garment of claim 1, wherein the garment is a sweatshirt.

4. The garment of claim 1, wherein the garment is a shirt.

5. The garment of claim 1, wherein said first aperture is formed in a shape of a triangle.

6. The garment of claim 5, wherein a vertex of the triangle is formed by overlapping portions integrally formed with the neck opening.

7. The garment of claim 1, wherein the brim covering region has a minimum distance between the perimeter of said first aperture and the perimeter of said second aperture when in a flat orientation, the minimum distance of the brim covering region being configured to be greater than the brim of the hat so that a portion of the perimeter of said first aperture which forms part of the brim covering region depends downwardly from the brim when said hood is in the deployed position.

8. The garment of claim 7, wherein the downwardly depending portion of the perimeter of said first aperture has a curve that parallels a portion of the perimeter of said second aperture in the deployed position.

* * * * *